US010867737B2

(12) United States Patent
Shibuya

(10) Patent No.: US 10,867,737 B2
(45) Date of Patent: Dec. 15, 2020

(54) DRUM CORE AND COIL COMPONENT

(71) Applicant: Murata Manufacturing Co., Ltd., Kyoto-fu (JP)

(72) Inventor: Kazuto Shibuya, Nagaokakyo (JP)

(73) Assignee: Murata Manufacturing Co., Ltd., Kyoto-fu (JP)

( * ) Notice: Subject to any disclaimer, the term of this patent is extended or adjusted under 35 U.S.C. 154(b) by 204 days.

(21) Appl. No.: 16/122,820

(22) Filed: Sep. 5, 2018

(65) Prior Publication Data

US 2019/0080835 A1 Mar. 14, 2019

(30) Foreign Application Priority Data

Sep. 12, 2017 (JP) ..... 2017-174428

(51) Int. Cl.

| | |
|---|---|
| ***H01F 17/04*** | (2006.01) |
| ***H01F 27/32*** | (2006.01) |
| ***H01F 27/28*** | (2006.01) |
| ***H01F 27/29*** | (2006.01) |

(52) U.S. Cl.

CPC ..... *H01F 17/045* (2013.01); *H01F 27/2823* (2013.01); *H01F 27/2828* (2013.01); *H01F 27/292* (2013.01); *H01F 27/32* (2013.01)

(58) Field of Classification Search

CPC .... H01F 17/045; H01F 27/32; H01F 27/2823; H01F 27/292; H01F 27/24; H01F 27/29

USPC ..... 336/212, 83, 192

See application file for complete search history.

(56) References Cited

U.S. PATENT DOCUMENTS

| | | | | |
|---|---|---|---|---|
| 7,358,842 | B1 * | 4/2008 | Liu | H01F 17/045 336/200 |
| 2008/0003864 | A1 * | 1/2008 | Hatakeyama | H01F 27/292 439/399 |
| 2008/0106363 | A1 | 5/2008 | Liu | |
| 2010/0214050 | A1 * | 8/2010 | Opina, Jr. | H01F 27/292 336/192 |

(Continued)

FOREIGN PATENT DOCUMENTS

| | | | |
|---|---|---|---|
| CN | 107045915 | A | 8/2017 |
| JP | 2005044946 | A | 2/2005 |

(Continued)

OTHER PUBLICATIONS

An Office Action; "Notification of Reasons for Refusal," Mailed by the Japanese Patent Office dated Dec. 3, 2019, which corresponds to Japanese Patent Application No. 2017-174428 and is related to U.S. Appl. No. 16/122,820; with English language translation.

*Primary Examiner* — Mang Tin Bik Lian

(74) *Attorney, Agent, or Firm* — Studebaker & Brackett PC

(57) ABSTRACT

A side surface of a flange part includes a central region having a straight surface and an outside region having an outside sloped surface. In the outside region, a ridge portion at which the outside sloped surface and an outside end surface are in contact with each other is chamfered into a first outside R surface. As a result, even when a swollen shape portion is formed at a location beyond the first outside R surface, the location where the swollen shape portion is formed is on the outside sloped surface, which is recessed from the straight surface toward the inside of the flange part. Thus, it is possible to reduce the degree and the probability of protruding of the swollen shape portion.

20 Claims, 4 Drawing Sheets

(56) References Cited

U.S. PATENT DOCUMENTS

| | | | | |
|---|---|---|---|---|
| 2015/0162126 | A1 | 6/2015 | Kanbe et al. | |
| 2017/0229230 | A1* | 8/2017 | Kawasaki | H01F 27/2828 |
| 2018/0374632 | A1* | 12/2018 | Kawahara | H01F 17/045 |

FOREIGN PATENT DOCUMENTS

| | | | | |
|---|---|---|---|---|
| JP | 2011-223025 | A | | 11/2011 |
| JP | 2015025189 | A | * | 2/2015 |
| JP | 2015025189 | A | | 2/2015 |
| JP | 2015115406 | A | | 6/2015 |

* cited by examiner

-Comparative Example-

DRUM CORE AND COIL COMPONENT

CROSS-REFERENCE TO RELATED APPLICATION

This application claims benefit of priority to Japanese Patent Application No. 2017-174428, filed Sep. 12, 2017, the entire content of which is incorporated herein by reference.

BACKGROUND

Technical Field

The present disclosure relates to a drum core including a core part for disposing a coil thereon in a coil component and a coil component formed by using the drum core. The present disclosure particularly relates to a drum core in which the shape of flange parts provided at respective mutually opposing end portions of the core part is improved.

Background Art

Japanese Unexamined Patent Application Publication No. 2011-223025 discloses a drum core having the configuration described below.

The drum core is made of ceramic and includes a core part for disposing a coil thereon and a first and second flange parts provided at respective mutually opposing end portions of the core part. The planar dimensions of the drum core are 1.1 mm or less in a longitudinal direction, and 0.6 mm or less in a lateral direction.

When a terminal electrode is arranged across ridges of the flange parts in such a drum core, the drum core encounters an issue in which the thickness of the terminal electrode decreases at the ridges and corners of the flange parts. In addition, when it is attempted to connect an end portion of the coil to the terminal electrodes by thermal pressure bonding, the drum core also encounters an issue in which edges formed by the ridges of the flange parts intrude into the end portion of the coil and the coil is cut by the edges.

To address these issues, Japanese Unexamined Patent Application Publication No. 2011-223025 suggests providing the corners and the ridges of the flange parts with curved surfaces having a curvature radius of 5 μm or more and not more than 25 μm (i.e., from 5 μm to 25 μm). The inventor of the present disclosure found that even when a drum core is designed to have curved surfaces (R surfaces) at corners and ridges of flange parts, as is described in Japanese Unexamined Patent Application Publication No. 2011-223025, the drum core sometimes fails to be formed into an intended shape as a result of molding.

Such a circumstance will be specifically described with reference to FIG. 5. FIG. 5 is a sectional view partially illustrating a drum core 1, that is, a core part 2 extending in an axial direction and one of two flange parts 3 provided at end portions corresponding thereto of the core part 2, the end portion opposing each other in the axial direction.

As a result of molding, the drum core 1 sometimes includes a swollen shape portion 4, as illustrated in FIG. 5, formed in a region beyond an R part of a ridge at which a side surface 5 and an outside end surface 6 of the flange part 3 are in contact with each other. For example, during handling of the drum core 1 in a manufacturing process of a coil component or during a mounting process after the coil component is manufactured, an external force is apt to be concentrated on the swollen shape portion 4 because the swollen shape portion 4 protrudes from the outer shape of the drum core 1. Therefore, there is a possibility that the drum core 1 is damaged.

SUMMARY

Accordingly, the present disclosure provides a drum core capable of reducing damage thereof even when such a swollen shape portion described above is formed, and a coil component formed by using the drum core. According to preferred embodiments of the present disclosure, there is provided a drum core used in a coil component. The drum core includes a core part for disposing a coil thereon. The core part extends in an axial direction and has end portions opposing each other in the axial direction. The drum core further comprises first and second flange parts provided at the end portions corresponding thereto of the core part. Each of the first and second flange parts has an inside end surface facing the core part and at which the end portion corresponding thereto of the core part is positioned, an outside end surface opposite to the inside end surface and facing outward, and first and second side surfaces connecting the inside end surface and the outside end surface to each other, the first and second side surfaces facing opposite sides.

In the drum core, to address the aforementioned technical issues, each of the first and second side surfaces includes an inside region adjacent to the inside end surface, an outside region adjacent to the outside end surface, and a central region between the inside region and the outside region. The central region has a straight surface extending in a direction parallel to the axial direction of the core part. The outside region has an outside sloped surface and a curved first outside R surface. The outside sloped surface is inclined from an end edge of the straight surface on a side of the outside end surface, or from a portion in a vicinity of the end edge in a direction toward a center portion of the outside end surface. The curved first outside R surface continues from the outside sloped surface and connects to the outside end surface.

According to the aforementioned configuration, even when a swollen shape portion is formed at a location beyond the first outside R surface, the location where the swollen shape portion is formed is on the outside sloped surface, which is recessed from the straight surface toward the inside of the flange part. Thus, it is possible to reduce the degree and the probability of protruding of the swollen shape portion from the straight surface (core outer shape).

According to the preferred embodiments of the present disclosure, a minimum dimension between the end edge of the straight surface on the side of the outside region and the outside end surface, measured in the axial direction of the core part is preferably about 0.10 mm or more, or about 30% or more and not more than about 50% (i.e., about 30% to about 50%) of a dimension between the outside end surface and the inside end surface. As a result of selecting such dimensions, a dimension of the outside sloped surface measured in the axial direction of the core part is increased, which ensures a reduction in the degree and the probability of protruding of the swollen shape portion from the straight surface (core outer shape).

According to the preferred embodiments of the present disclosure, a minimum dimension between the straight surface and an end edge of the outside sloped surface on the side of the outside end surface, measured in a direction perpendicular to the axial direction of the core part and extending along a line connecting the first and second side surfaces is preferably about 0.004 mm or more, or about 0.4% or more of a dimension between the first and second side surfaces, and a minimum dimension between the straight surface and an end edge of the first outside R surface on the side of the outside end surface, measured in the direction perpendicular to the axial direction of the core part and extending along the line connecting the first and second side surfaces, is preferably about 0.06 mm or more, or about 5% or more, and not more than about ⅓, of the dimension between the first and second side surfaces. As a result of selecting such dimensions, the degree of the inclination of the outside sloped surface is increased, which ensures a reduction in the degree and the probability of protruding of the swollen shape portion from the straight surface (core outer shape).

According to the preferred embodiments of the present disclosure, the outside region preferably has a curved second outside R surface that continues from the outside sloped surface and connects to the straight surface. According to such a configuration, it is possible to reduce sharpness of a portion at which the outside sloped surface and the straight surface are in contact with each other, and thus, it is possible to more reliably reduce damage of the drum core.

According to the preferred embodiments of the present disclosure, each of the first and second side surfaces preferably includes, in the inside region, an inside sloped surface and a curved first inside R surface. The inside sloped surface is inclined from an end edge of the straight surface on a side of the inside end surface or from a portion in a vicinity of the end edge in a direction toward a center portion of the inside end surface. The curved first inside R surface continues from the inside sloped surface and connects to the inside end surface. According to such a configuration, even when a swollen shape portion is formed also at an inside portion, it is possible to reduce the degree and the probability of protruding of the swollen shape portion from the straight surface (core outer shape).

According to the preferred embodiments of the present disclosure, the drum core is preferably formed of ceramic. Compared with, for example, a resin drum core, a ceramic drum core is easily damaged; thus, an effect according to the preferred embodiments of the present disclosure is remarkably exhibited.

According to the preferred embodiments of the present disclosure, each of the first and second flange parts of the drum core preferably has a bottom surface and a top surface opposite to the bottom surface. The bottom surface connects the inside end surface and the outside end surface to each other, and the first side surface and the second side surface to each other, and faces a mount substrate when being mounted thereon, and each of the first and second flange parts preferably includes a terminal electrode on the bottom surfaces thereof. As a result of the provision of the terminal electrodes on the bottom surfaces, portions of the bottom surfaces where the electrodes are disposed are covered by the electrodes and are thus prevented from being directly exposed to the outside when the core (coil component) is handled. Therefore, a slight protruding portion causes no issues. Moreover, even when the straight surface is reduced due to the formation of the outside sloped surface, mounting of the coil component and the like are not affected as a result of the formation of the terminal electrodes on the bottom surfaces.

According to preferred embodiments of the present disclosure, there is also provided a coil component configured by using the aforementioned drum core. Namely, the coil component according to the preferred embodiments of the present disclosure includes the aforementioned drum core, and at least one coil wound around the core part and connected to the terminal electrodes.

According to the preferred embodiments of the present disclosure, the coil component may further include a plate core bridging the top surfaces of the first and second flange parts.

According to the preferred embodiments of the present disclosure, the drum core is capable of reducing the degree and the probability of protruding of the swollen shape portion from the straight surface (core outer shape) and reducing damage of the drum core during handling of the drum core in a manufacturing process of the coil component or during a mounting process after the coil component is manufactured.

Other features, elements, characteristics and advantages of the present disclosure will become more apparent from the following detailed description of preferred embodiments of the present disclosure with reference to the attached drawings.

DETAILED DESCRIPTION

Figure 1:
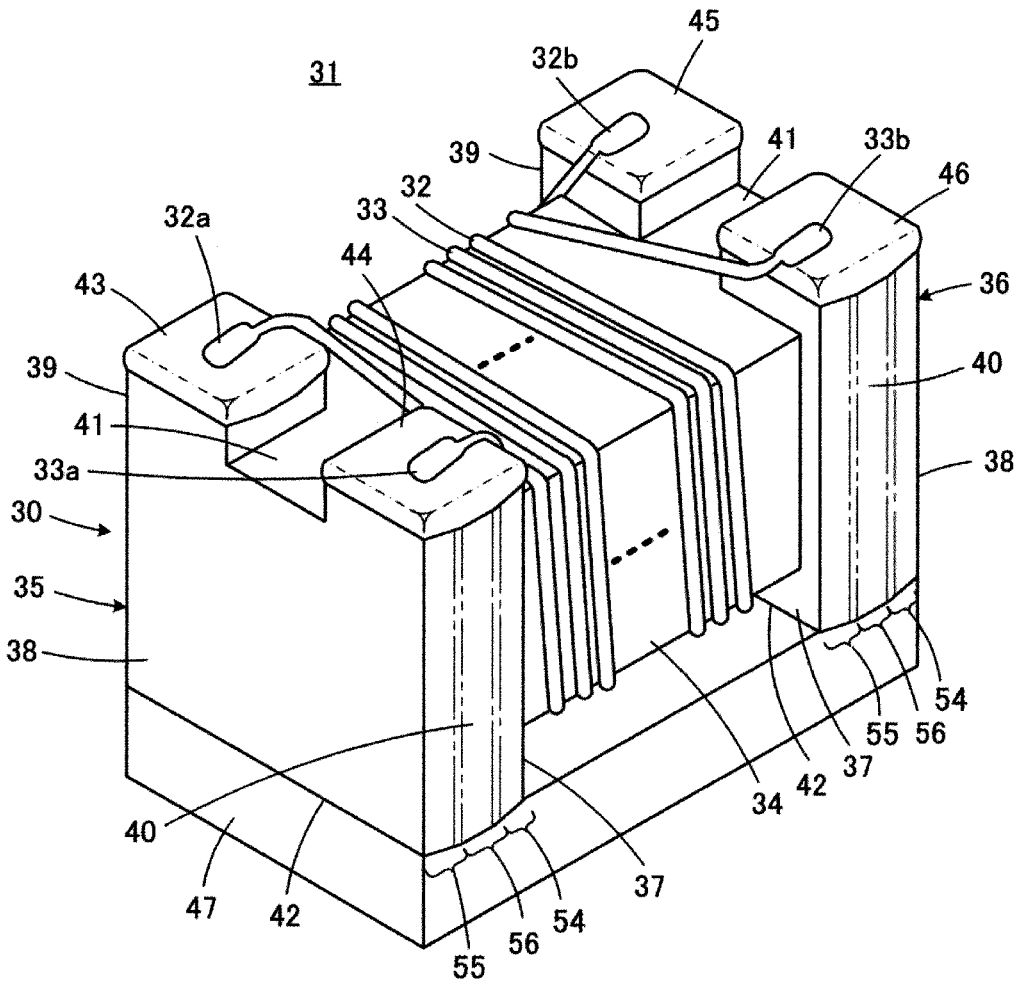
FIG. 1 is a perspective view illustrating an appearance of a coil component, with a surface thereof configured to face a mount substrate is directed upward, including a drum core according to an embodiment of the present disclosure.
Figure 2:
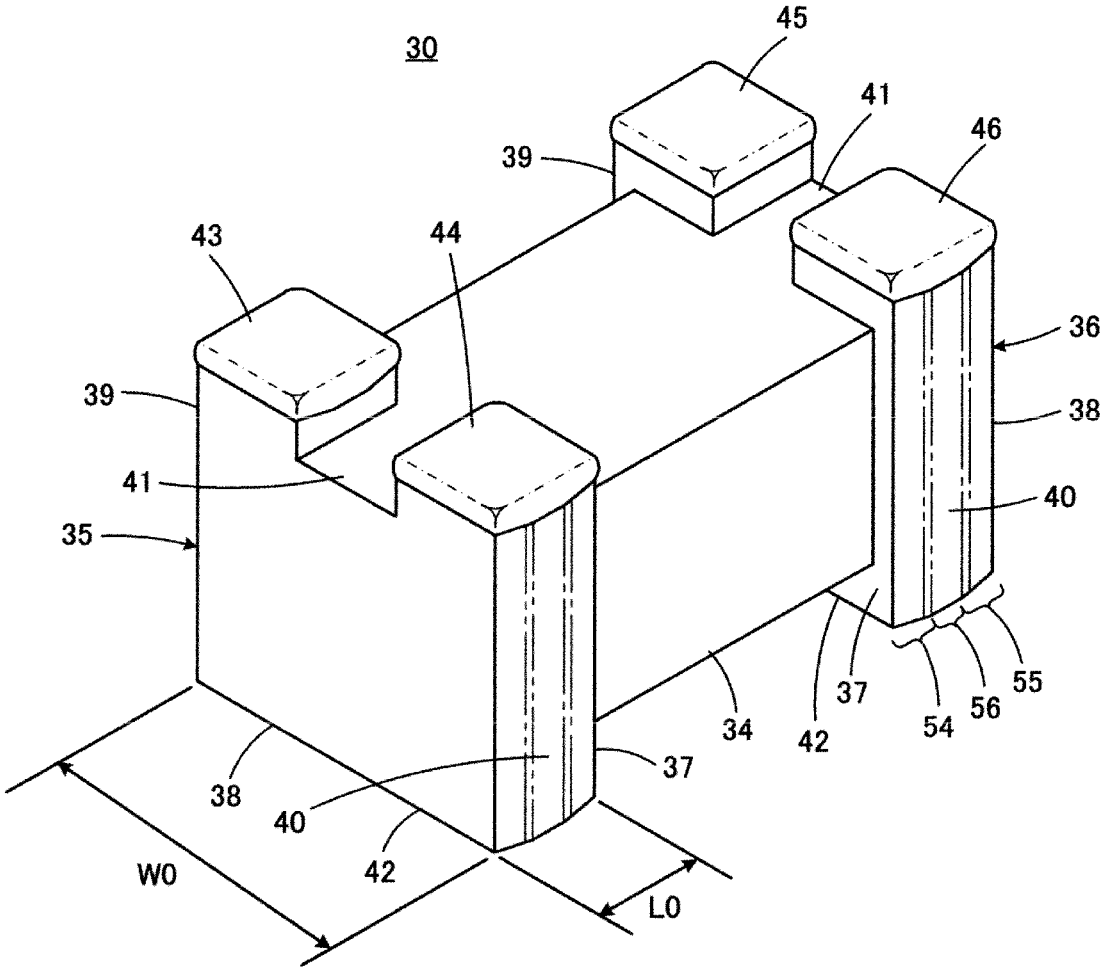
FIG. 2 is a perspective view separately illustrating the drum core included in the coil component illustrated in FIG. 1.

First, a coil component 31 that includes a drum core 30 according to an embodiment of the present disclosure will be described with reference to FIGS. 1 to 3. FIGS. 1 and 2 each illustrate the coil component 31 or the drum core 30 in a state in which a surface thereof configured to face a mount substrate is directed upward. The illustrated coil component 31 constitutes, for example, a common mode choke coil.

The drum core 30 included in the coil component 31 has a shape extending in a direction along an axis 48 (refer to FIG. 3) and includes a core part 34 on which coils 32 and 33 are disposed; and first and second flange parts 35 and 36 provided at end portions corresponding thereto of the core part 34, the end portions opposing each other in the direction along the axis 48. The drum core 30 may be formed of, for example, an electrical insulating material, specifically, a non-magnetic material such as alumina, a magnetic material such as ferrite, or a resin. Preferably, the drum core 30 is formed of ceramic such as alumina or ferrite.

The core part 34 and the first and second flange parts 35 and 36 included in the drum core 30 each have, for example, a substantially rectangular columnar shape having a substantially rectangular sectional shape. Preferably, the substantially rectangular columnar shaped core part 34 and the substantially rectangular columnar shaped flange parts 35 and 36 are R-chamfered at respective ridge portions thereof.

Each of the first and second flange parts 35 and 36 has an inside end surface 37 facing the core part 34 and at which the end portion corresponding thereto of the core part 34 is positioned and an outside end surface 38 opposite to the inside end surface 37 and facing outward. In addition, each of the first and second flange parts 35 and 36 has first and second side surfaces 39 and 40 connecting the inside end surface 37 and the outside end surface 38 to each other. The first and second side surfaces 39 and 40 face opposite sides. Moreover, each of the first and second flange parts 35 and 36 has a bottom surface 41 and a top surface 42 opposite to the bottom surface 41. The bottom surface 41 connects the inside end surface 37 and the outside end surface 38 to each other and the first side surface 39 and the second side surface 40 to each other. The bottom surface 41 faces the mount substrate when being mounted thereon.

The bottom surface 41 of the first flange part 35 is provided with terminal electrodes 43 and 44. The bottom surface 41 of the second flange part 36 is provided with terminal electrodes 45 and 46. The bottom surfaces 41 of the flange parts 35 and 36 include projecting step portions at positions where the respective terminal electrodes 43 to 46 are provided. Normally, a conductive paste containing silver as a conductive component is baked to form the terminal electrodes 43 to 46, and the terminal electrodes 43 to 46 may be plated with Ni, Cu, Sn, or the like, as necessary. As an alternative to the conductive paste, terminal metal fittings formed of conductive metal may be bonded to the respective flange parts 35 and 36 to form the terminal electrodes 43 to 46.

The aforementioned coils 32 and 33 are formed of, for example, copper wires covered and insulated with a resin of polyurethane, polyimide, or the like. The first and second coils 32 and 33 are in a state of being wound in a spiral shape around the core part 34. The first coil 32 has a first end 32*a* connected to the terminal electrode 43 and a second end 32*b*, which is opposite to the first end 32*a*, connected to the terminal electrode 45. The second coil 33 has a first end 33*a* connected to the terminal electrode 44 and a second end 33*b*, which is opposite to the first end 33*a*, connected to the terminal electrode 46. For example, thermal pressure bonding is employed for connecting the coils 32 and 33 to the respective terminal electrodes 43 to 46.

The coil component 31 may further include a plate core 47 bridging the top surfaces 42 of the respective first and second flange parts 35 and 36. Similarly to the drum core 30, the plate core 47 is also formed of, for example, an electrical insulating material, specifically, a non-magnetic material such as alumina, a magnetic material such as ferrite, or a resin. The plate core 47 is secured with an adhesive to the drum core 30.

As an alternative to the plate core 47, resin coating may be applied on a side, opposite to the side where the terminal electrodes 43 to 46 are provided, of the flange parts 35 and 36, that is, on the side of the top surfaces 42 so as to link a pair of the flange parts 35 and 36 to each other. Such resin coating may be applied not only on the side of the top surfaces 42 but also on the side of the side surfaces 39 and 40 and the side of the bottom surfaces 41.

Next, characteristic configurations of the flange parts 35 and 36 of the drum core 30 will be described.

Figure 5:
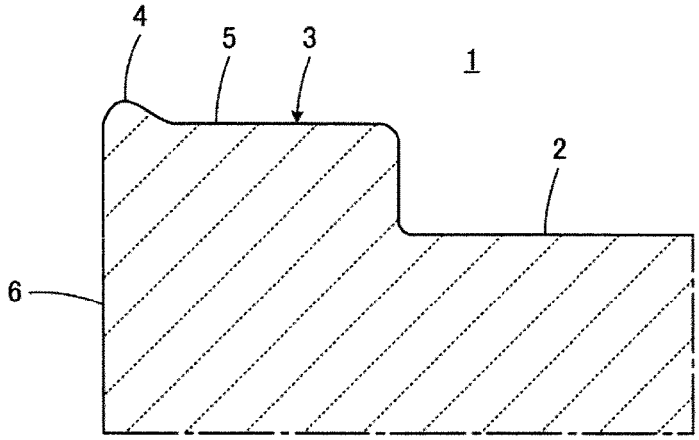
FIG. 5 is a sectional view partially illustrating a known drum core.

As described above with reference to FIG. 5, the known drum core 1 sometimes includes the swollen shape portion 4 formed in the region beyond the R part of the ridge at which the side surface 5 and the outside end surface 6 of the flange part 3 are in contact with each other. There is a possibility that the swollen shape portion 4 causes damage of the drum core 1. Thus, to prevent such inconvenience from easily occurring, the configuration described below is employed.

For describing the first and second side surfaces 39 and 40 of the first and second flange parts 35 and 36, each of the first and second side surfaces is divided into three regions as an inside region 54 adjacent to the inside end surface 37, an outside region 55 adjacent to the outside end surface 38, and a central region 56 between the inside region 54 and the outside region 55, as illustrated in FIGS. 1 and 2.

Figure 3:
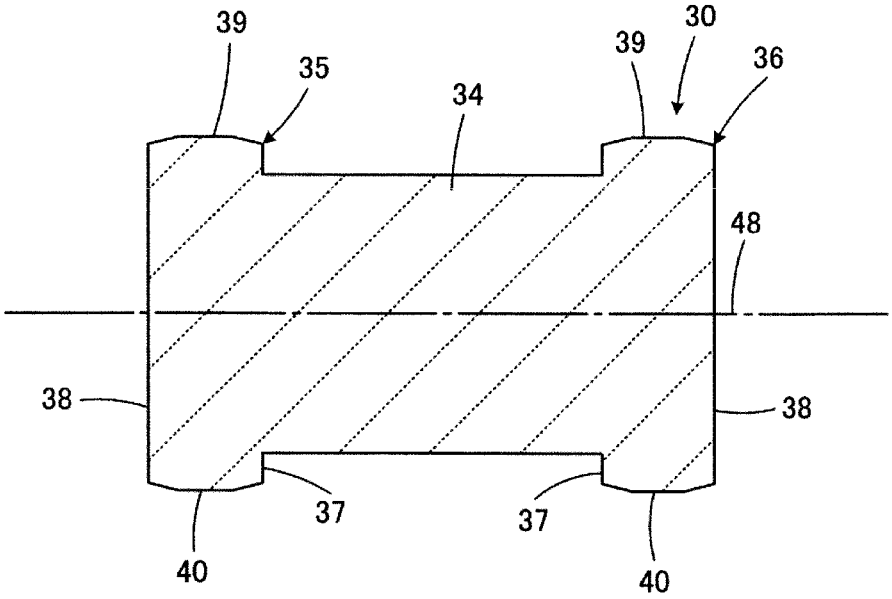
FIG. 3 is a longitudinal sectional view of the drum core illustrated in FIG. 2.
Figure 4:
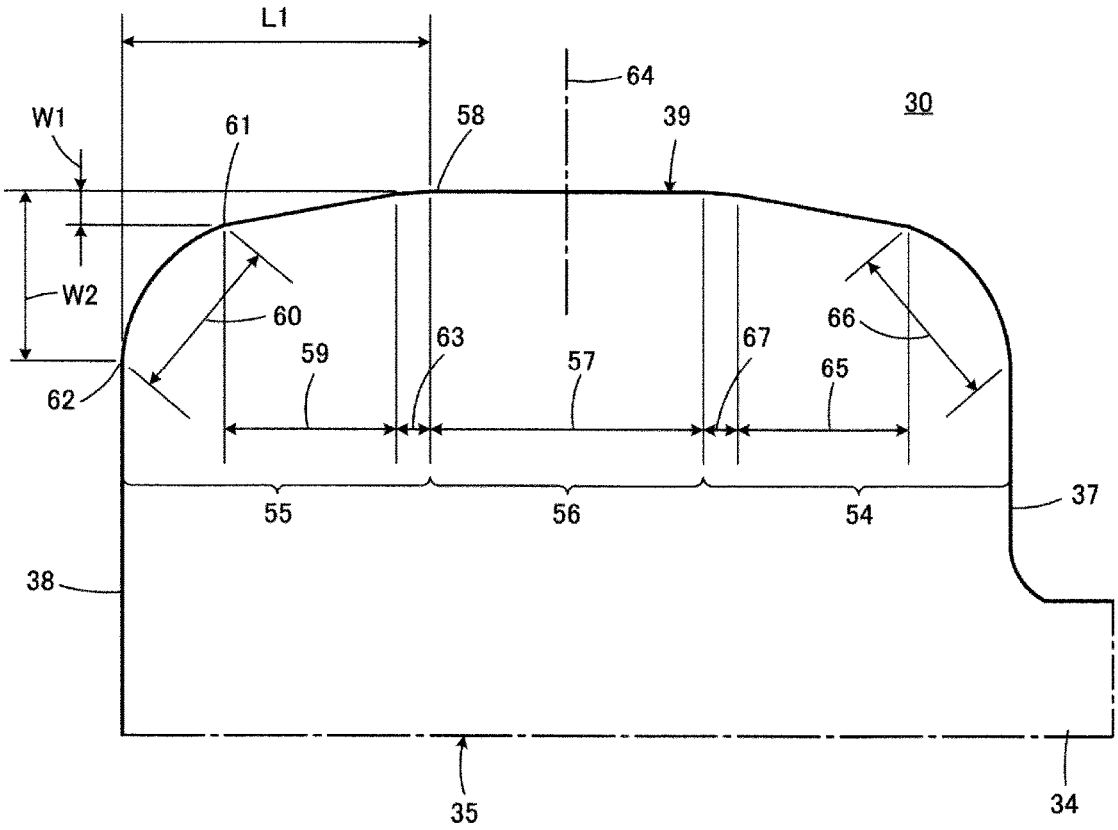
FIG. 4 is a schematic view of a first flange part of the drum core illustrated in FIG. 2, illustrating an enlargement of a sectional shape thereof on the side of the first side surface.

FIG. 3 is a longitudinal sectional view of the drum core 30 illustrated in FIG. 2. FIG. 4 is a schematic view of the first flange part 35 of the drum core 30, illustrating an enlargement of a sectional shape thereof on the side of the first side surface 39.

Representatively, the first side surface 39 of the first flange part 35 illustrated in FIG. 4 will be described. The central region 56 has a straight surface 57 extending in a direction parallel to the direction along the axis 48 of the core part 34. The outside region 55 has an outside sloped surface 59 and a curved first outside R surface 60. The outside sloped surface 59 is inclined from an end edge 58 of the straight surface 57 on the side of the outside end surface 38 or from a portion in the vicinity of the end edge 58 in a direction toward a center portion of the outside end surface 38. The first outside R surface 60 continues from the outside sloped surface 59 and connects to the outside end surface 38. Note that the shape of the first side surface 39 illustrated in FIG. 4 is exaggerated in terms of dimensions in an up-down direction of the drawing compared with the actual dimensions thereof.

According to the aforementioned configuration, even when a swollen shape portion is formed at a location beyond the first outside R surface 60, the location where the swollen shape portion is formed is on the outside sloped surface 59, which is recessed from the straight surface 57 toward the inside of the flange part 35. Thus, it is possible to reduce the degree and the probability of protruding of the swollen shape portion from the straight surface 57 (core outer shape).

In the present embodiment, a minimum dimension L1 between the end edge 58 of the straight surface 57 on the side of the outside region 55 and the outside end surface 38, measured in the direction along the axis 48 of the core part 34 is preferably about 0.10 mm or more, or about 30% or more and not more than 50% (i.e., about 30% to 50%) of a dimension L0 (refer to FIG. 2) between the outside end surface 38 and the inside end surface 37. As a result of selecting such dimensions, a dimension of the outside sloped surface 59 measured in the direction along the axis 48 (refer to FIG. 3) of the core part 34 is increased, which ensures a reduction in the degree and the probability of protruding of the swollen shape portion from the straight surface 57 (core outer shape).

In addition, in the present embodiment, a minimum dimension W1 between the straight surface 57 and an end edge 61 of the outside sloped surface 59 on the side of the outside end surface 38, measured in a direction perpendicular to the direction of the axis 48 of the core part 34 and extending along a line connecting the first and second side surfaces 39 and 40 is preferably about 0.004 mm or more, or about 0.4% or more, of a dimension W0 (refer to FIG. 2) between the first and second side surfaces 39 and 40. A minimum dimension W2 between the straight surface 57 and an end edge 62 of the first outside R surface 60 on the side of the outside end surface 38, measured in the direction perpendicular to the direction of the axis 48 of the core part 34 and extending along the line connecting the first and second side surfaces 39 and 40 is preferably about 0.06 mm or more, or about 5% or more, and not more than about ⅓, of the dimension W0 between the first and second side surfaces 39 and 40. As a result of selecting such dimensions, the degree of the inclination of the outside sloped surface 59 is increased, which ensures a reduction in the degree and the probability of protruding of the swollen shape portion from the straight surface 57 (core outer shape).

Moreover, in the present embodiment, the outside region 55 preferably has a curved second outside R surface 63 that continues from the outside sloped surface 59 and connects to the straight surface 57. According to such a configuration, it is possible to reduce sharpness of a portion at which the outside sloped surface 59 and the straight surface 57 are in contact with each other, and thus, it is possible to more reliably reduce damage of the drum core 30.

Further, in the present embodiment, each of the first and second side surfaces 39 and 40 preferably includes, in the inside region 54, an inside sloped surface 65 and a curved first inside R surface 66. The inside sloped surface 65 is inclined from an end edge of the straight surface 57 on the side of the inside end surface 37 or from a portion in the vicinity of the end edge in a direction toward a center portion of the inside end surface 37. The curved first inside R surface 66 continues from the inside sloped surface 65 and connects to the inside end surface 37. According to such a configuration, even when a swollen shape portion is formed also at an inside portion, it is possible to reduce the degree and the probability of protruding of the swollen shape portion from the straight surface 57 (core outer shape).

Furthermore, in the present embodiment, the inside region 54 preferably has a curved second inside R surface 67 that continues from the inside sloped surface 65 and connects to the straight surface 57. According to such a configuration, it is possible to reduce sharpness of a portion at which the inside sloped surface 65 and the straight surface 57 are in contact with each other, and thus, it is possible to more reliably reduce damage of the drum core 30.

Characteristic forms, such as those described above, provided in the side surfaces 39 and 40 are imparted during molding of the drum core 30. In other words, the characteristic forms are basically not imparted as a result of, for example, post-processing such as barrel polishing after molding. If the drum core 1 is subjected to barrel polishing after being molded, R chamfers, such as the first outside R surface 60 and the first inside R surface 66, are formed on the entire drum core 1. In contrast, the characteristic forms that include sloped surfaces, such as the outside sloped surface 59 and the inside sloped surface 65, provided on each of the side surfaces 39 and 40 are not achieved by barrel polishing. Therefore, the characteristic forms according to the present disclosure are identified by the presence of such sloped surfaces.

Barrel polishing treatment is one option to remove the swollen shape portion 4 described above with reference to FIG. 5; however, an effect thereof is not sufficient. If barrel polishing treatment is performed to sufficiently remove the swollen shape portion 4, portions unnecessary to be removed are also subjected to the polishing, and furthermore, there is a possibility that micro cracks are formed in the drum core 1.

In a case of handling the drum core 1 that includes the swollen shape portion 4, providing manufacturing facilities with modifications is one option to prevent the swollen shape portion 4 from being subjected to an external force. However, this requires dedicated facilities to be introduced and leads to complex processes and a cost increase, which is not desirable.

The present disclosure has been described above based on the illustrated embodiment; however, the present disclosure may be carried out in other various embodiments within the scope of the present disclosure.

For example, the second outside R surface 63, the second inside R surface 67, the inside sloped surface 65, the first inside R surface 66, and the like in the aforementioned embodiment may be omitted. Moreover, the first outside R surface 60 and the outside sloped surface 59 may be formed on one of, instead of both, the first and second side surfaces 39 and 40.

The aforementioned embodiment relates to the coil component that constitutes the common mode choke coil; however, the coil component may constitute, for example, a transformer or a single coil. Thus, the number of the coils varies in accordance with functions of the coil component. For example, the number of the coils may be one or three or more. In accordance with the number of the coils, the number of the terminal electrodes provided on each flange part may be one or three or more.

While preferred embodiments of the disclosure have been described above, it is to be understood that variations and modifications will be apparent to those skilled in the art without departing from the scope and spirit of the disclosure. The scope of the disclosure, therefore, is to be determined solely by the following claims.

What is claimed is:

1. A drum core used in a coil component, the drum core comprising:

a core part for disposing a coil thereon, the core part extending in an axial direction and having end portions opposing each other in the axial direction; and first and second flange parts provided at the end portions corresponding thereto of the core part, wherein each of the first and second flange parts has an inside end surface facing the core part and at which the end portion corresponding thereto of the core part is located, an outside end surface opposite to the inside end surface and facing outward, and first and second side surfaces connecting the inside end surface and the outside end surface to each other, the first and second side surfaces facing opposite sides, each of the first and second side surfaces includes an inside region adjacent to the inside end surface, an outside region adjacent to the outside end surface, and a central region between the inside region and the outside region, the central region has a straight surface extending in a direction parallel to the axial direction of the core part, the outside region has an outside sloped surface and a curved first outside R surface, the outside sloped surface is inclined from an end edge of the straight surface on a side of the outside end surface or from a portion in a vicinity of the end edge in a direction toward a center portion of the outside end surface, and the curved first outside R surface continues from the outside sloped surface and connecting to the outside end surface.

2. The drum core according to claim 1, wherein a minimum dimension between the end edge of the straight surface on the side of the outside region and the outside end surface, measured in the axial direction of the core part, is about 0.10 mm or more.

3. The drum core according to claim 1, wherein
a minimum dimension between the end edge of the straight surface on the side of the outside region and the outside end surface, measured in the axial direction of the core part, is about 30% to about 50% of a dimension between the outside end surface and the inside end surface.

4. The drum core according to claim 1, wherein
a minimum dimension between the straight surface and an end edge of the outside sloped surface on the side of the outside end surface, measured in a direction perpendicular to the axial direction of the core part and extending along a line connecting the first and second side surfaces, is about 0.004 mm or more.

5. The drum core according to claim 1, wherein
a minimum dimension between the straight surface and an end edge of the outside sloped surface on the side of the outside end surface, measured in a direction perpendicular to the axial direction of the core part and extending along a line connecting the first and second side surfaces, is about 0.4% or more of a dimension between the first and second side surfaces.

6. The drum core according to claim 1, wherein
a minimum dimension between the straight surface and an end edge of the first outside R surface on the side of the outside end surface is about 0.06 mm or more.

7. The drum core according to claim 1, wherein
a minimum dimension between the straight surface and an end edge of the first outside R surface on the side of the outside end surface is about 5% or more, and not more than about ⅓, of the dimension between the first and second side surfaces.

8. The drum core according to claim 1, wherein
the outside region has a curved second outside R surface that continues from the outside sloped surface and connects to the straight surface.

9. The drum core according to claim 1, wherein
each of the first and second side surfaces includes, in the inside region, an inside sloped surface and a curved first inside R surface,
the inside sloped surface is inclined from an end edge of the straight surface on a side of the inside end surface or from a portion in a vicinity of the end edge in a direction toward a center portion of the inside end surface, and
the curved first inside R surface continues from the inside sloped surface and connects to the inside end surface.

10. The drum core according to claim 1, wherein
the drum core is made of ceramic.

11. The drum core according to claim 1, wherein
each of the first and second flange parts has a bottom surface facing a mount substrate when being mounted thereon and a top surface opposite to the bottom surface,
the bottom surface and the top surface connect the inside end surface and the outside end surface to each other and the first side surface and the second side surface to each other, and
each of the first and second flange parts includes a terminal electrode on the bottom surface thereof.

12. A coil component comprising:
the drum core according to claim 11; and
the coil wound around the core part and connected to the terminal electrodes.

13. The coil component according to claim 12, further comprising
a plate core bridging the top surfaces of the first and second flange parts.

14. The drum core according to claim 2, wherein
a minimum dimension between the straight surface and an end edge of the outside sloped surface on the side of the outside end surface, measured in a direction perpendicular to the axial direction of the core part and extending along a line connecting the first and second side surfaces, is about 0.004 mm or more.

15. The drum core according to claim 2, wherein
a minimum dimension between the straight surface and an end edge of the outside sloped surface on the side of the outside end surface, measured in a direction perpendicular to the axial direction of the core part and extending along a line connecting the first and second side surfaces, is about 0.4% or more of a dimension between the first and second side surfaces.

16. The drum core according to claim 2, wherein
a minimum dimension between the straight surface and an end edge of the first outside R surface on the side of the outside end surface is about 0.06 mm or more.

17. The drum core according to claim 2, wherein
a minimum dimension between the straight surface and an end edge of the first outside R surface on the side of the outside end surface is about 5% or more, and not more than about ⅓, of the dimension between the first and second side surfaces.

18. The drum core according to claim 2, wherein
the outside region has a curved second outside R surface that continues from the outside sloped surface and connects to the straight surface.

19. The drum core according to claim 2, wherein
each of the first and second side surfaces includes, in the inside region, an inside sloped surface and a curved first inside R surface,
the inside sloped surface is inclined from an end edge of the straight surface on a side of the inside end surface or from a portion in a vicinity of the end edge in a direction toward a center portion of the inside end surface, and
the curved first inside R surface continues from the inside sloped surface and connects to the inside end surface.

20. The drum core according to claim 2, wherein
the drum core is made of ceramic.

* * * * *